United States Patent [19]

Dabney

[11] Patent Number: 4,891,853

[45] Date of Patent: Jan. 9, 1990

[54] BOX SPRING ASSEMBLY

[75] Inventor: Upton R. Dabney, Georgetown, Ky.

[73] Assignee: Hoover Group, Inc., Alphretta, Ga.

[21] Appl. No.: 264,024

[22] Filed: Oct. 28, 1988

[51] Int. Cl.[4] ..... A47C 23/02

[52] U.S. Cl. ..... 5/247; 5/255; 267/107

[58] Field of Search ..... 5/247, 255; 267/107, 267/103

[56] References Cited

U.S. PATENT DOCUMENTS

| | | | |
|---|---|---|---|
| 4,559,654 | 12/1985 | Mizelle | 5/255 |
| 4,675,927 | 6/1987 | Mizelle | 5/247 |
| 4,704,752 | 11/1987 | Yates et al. | 5/247 |
| 4,730,357 | 3/1988 | Wells | 5/247 |
| 4,736,933 | 4/1988 | Hagemeister | 267/103 |
| 4,776,562 | 10/1988 | Surletta et al. | 5/247 X |
| 4,778,157 | 10/1988 | Thomas | 267/103 |
| 4,779,293 | 10/1988 | Dabney | 5/247 |

*Primary Examiner*—Gary L. Smith
*Assistant Examiner*—Michael J. Milano
*Attorney, Agent, or Firm*—Harness, Dickey & Pierce

[57] ABSTRACT

A non-coil spring is disclosed for use in a box spring assembly. The spring is a limited deflection spring having a lower portion for mounting to the frame of the box spring assembly, an upper attaching platform portion for attaching to a wire mattress support deck and an intermediate portion for resiliently supporting the upper attaching platfor spaced from the lower mounting portion. The intermediate portion inclues a pair of collapsible column sections having middle torsion bars which are connected to upper torsion bars in the attaching platform and lower torsion bars in the mounting portion by connecting bars which each diverge away from an end of the middle torsion bars in the column sections. During loading, these middle torsion bars in the column sections move toward each other until they engage in a cross bucking fashion to limit further deflection of the spring. At full deflection the platform is a predetermined spaced distance above the engaged middle torsion bars. The platform is allowed to resiliently pivot relative to the engaged middle torsion bars to conform to the bedding load distribution to improve comfort. For a given width spring, the torsional stresses in the torsion bars are lower than in other spring designs thus increasing the life of the spring.

6 Claims, 2 Drawing Sheets

BOX SPRING ASSEMBLY

BACKGROUND OF THE INVENTION

This invention relates generally to mattress foundation structures and more particularly to a box spring assembly of a type which utilizes non-coil springs. Box spring assemblies of this general type have been known since 1964, the first such spring assembly being disclosed in U.S. Pat. No. 3,286,281. Subsequently issued patents disclosing the same general type of box spring assembly are: U.S. Pat. Nos. 3,487,480; 3,506,987; 3,574,240; 3,574,241; 3,665,529; 3,680,157; 3,755,833; 3,824,639; 3,852,838; 4,060,862; 4,120,058; 4,131,961; 4,195,376; 4,218,790; 4,238,861; 4,251,892; 4,253,208 and 4,470,584. Box spring assemblies of the general type shown in the above list of patents, all of which are assigned to the assignee of this application, are advantageous with respect to the conventional box spring assemblies using coil springs because they provide a desired stiffer foundation for the mattress and contain a reduced amount of wire. These box spring assemblies are also advantageous from the standpoints of prolonged service life, ease of assembly, and cost of manufacture.

Additional box spring assemblies of this general type are shown in U.S. Pat. Nos. 3,546,723; 3,596,299; 3,722,013; 3,825,960; 3,833,948; 3,835,485; 3,869,740; 3,990,121; 4,000,531 and 4,559,654.

The present invention provides a box spring assembly which utilizes a wire mattress support deck or platform and a supporting spring that is different from the formed wire springs utilized in the patented box spring assemblies discussed above. The spring in the present box spring assembly is improved from the standpoint of providing desired qualities of firmness, internal strength, and edge support to the wire deck.

SUMMARY OF THE INVENTION

The box spring assembly of this invention consists of a rectangular frame having side rails, end rails, and a plurality of cross rails that are generally parallel to each other and to the end rails and are substantially perpendicular to the side rails. The box spring assembly also includes a rectangular wire mattress support deck positioned above the frame and a plurality of limited deflection wire springs that are mounted on the cross rails and end rails and connected to the deck so as to yieldably resist downwardly directed bedding loads.

Each of the springs is formed of spring steel wire and includes a pair of vertically collapsible column sections which are connected at their lower ends to a lower mounting portion and at their upper ends to an upper attaching platform portion. The lower mounting portion includes a pair of horizontal mounting feet having transverse torsion bars located between the mounting feet and column sections. The upper attaching platform includes a straight wire for attaching to the grid, a pair of transverse torsion bars on opposite sides of the straight wire and parallel to the straight wire and joined to opposite ends of the straight wire by cross wires. The column sections include a torsion bar spaced vertically and horizontally from the torsion bars of the lower mounting portion and upper attaching platform. Upper and lower connecting bars connect the torsion bars of the column sections with the torsion bars of the upper attaching platform and lower mounting portion. The upper connecting bars diverge in an upward direction while the lower connecting bars diverge in a downward direction.

During loading, the spring deflects vertically downward as the torsion bars in the column sections move inward until the torsion bars engage one another to limit the spring deflection. This occurs while the upper attaching portion is still vertically spaced from the engaged torsion bars. The use of three torsion bars, one in each portion of the spring, results in a lower peak torsional stress in the spring, producing a longer life spring and permitting the use of smaller diameter wire. In addition, the platform is allowed to rotate about the engaged torsion bars, allowing the wire platform to conform to the bedding load, increasing comfort.

Further objects, features and advantages of the invention will become apparent from a consideration of the following description and the appended claims when taken in connection with the accompanying drawing.

DETAILED DESCRIPTION OF THE INVENTION

Figure 1:
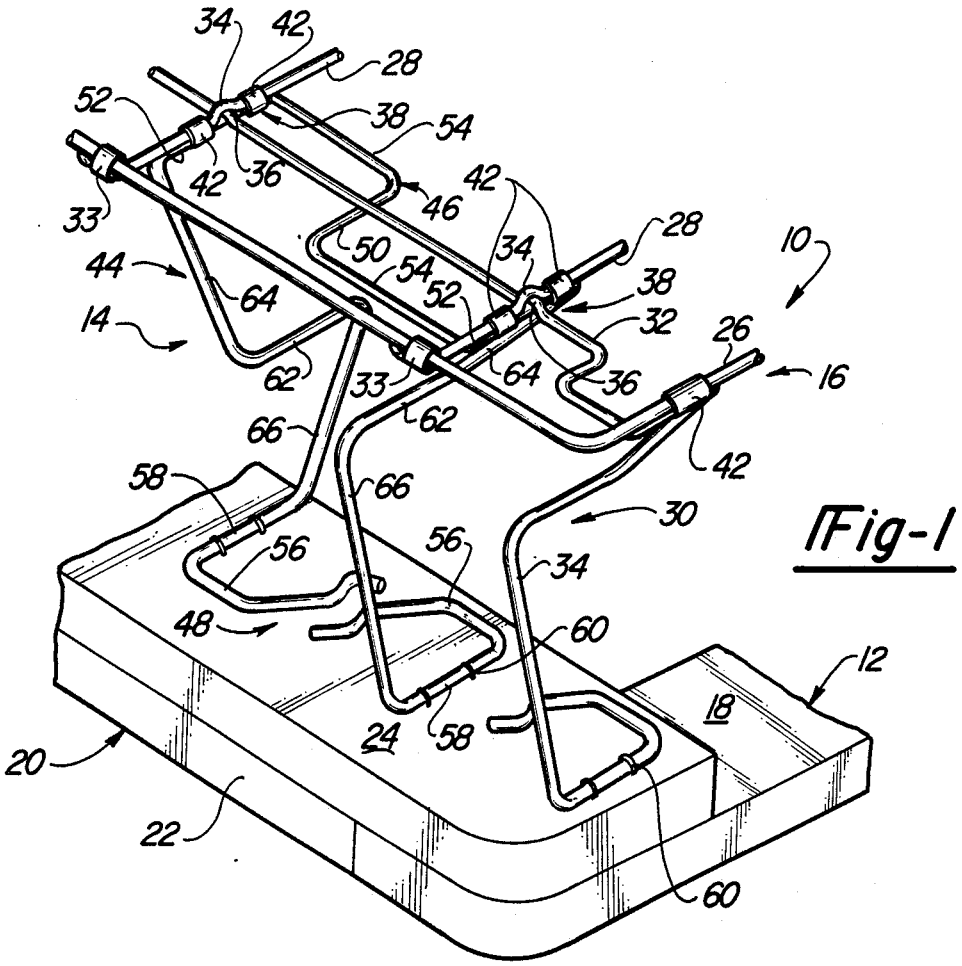
FIG. 1 is a fragmentary perspective view of the box spring assembly of this invention, showing a representative intermediate support spring supported at its lower end on an end rail and one cross wire spring mounted at one end on a cross rail, both being in supporting relation at their upper ends with the box spring wire deck.

With reference to the drawing, a fragmentary portion of a box spring assembly of this invention indicated generally at 10 is ilustrated in FIG. 1. The box spring assembly 10 includes a generally rectangular, horizontally disposed frame 12, a plurality of wire intermediate support springs 14 mounted to the top of the frame 12 and a horizontally disposed wire mattress support deck 16 mounted on the springs 14.

The frame 12, generally constructed of wood, has side rails 18 and end rails 20. The end rails 20 include a lower member 22, each end of which is connected to the side rail 18 and an upper member 24 which overlies the lower member 22 and overlaps the end of side rail 18. Horizontally spaced from and parallel to the end rails are a plurality of cross rails (not shown) which overlap the side rails 18 and are coplaner with the upper members 24 of end rails 20. The cross rails are not shown as the arrangement of springs 14 mounted thereon is identical to that illustrated in FIG. 1.

The wire mattress support deck 16 forms a platform disposed in a horizontal plane at a predetermined distance above the frame 12. The mattress support deck 16 includes border wire 26, long wires 28 and a portion of cross wire springs 30. Each of the cross wire springs 30 has an elongated load bearing portion 32 and a vertically yieldable portion 34. The long wires 28 and the load bearing portions 32 of the cross wire springs 30 are arranged in a criss-cross fashion with the load bearing portions 32 of cross wire springs 30 intersecting the long wires 28. The ends of the long wire 28 are fastened to border wire 26 with clips 33.

Each long wire has a plurality of spaced apart notches 34 along its length. Likewise, each load bearing portion 32 of each of the cross wire springs 30 has a plurality of spaced apart notches 36. Each of the notches 36 is an upwardly arched deflection in the wire member. Notches 34 saddle notches 36 at intersections 38 between the long wires 28 and cross wire springs 30. The engagement of notches 34 and 36 of long wires 28 and load bearing portions 32 of cross wire springs 30 respectively prevents side ways movement of the wire members at the notched intersections 38. The ends of the load bearing portions 32 of the cross wire springs 30 are attached to border wire 26 by clips 42.

Figure 2:
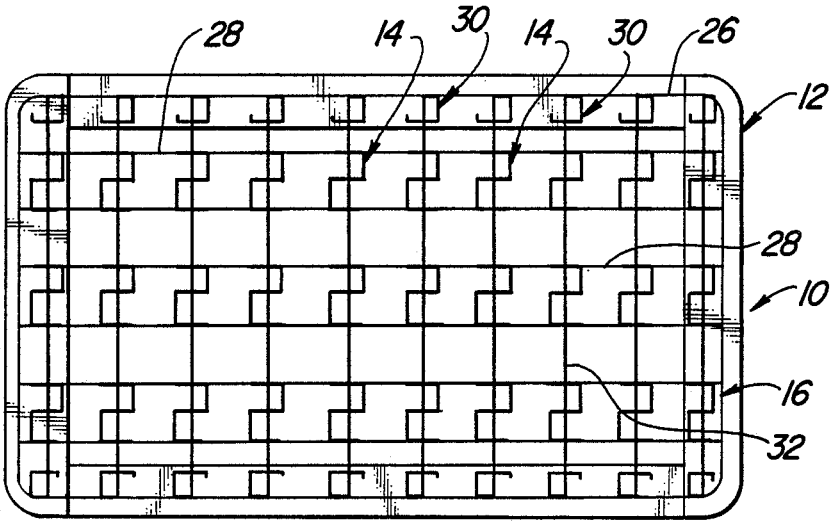
FIG. 2 is a diagrammatic plan view of a box spring assembly of this invention illustrating one arrangement of the supporting springs on the frame to support the wire deck.

A plurality of limited deflection intermediate support springs 14, arranged in a predetermined pattern on frame 12, yieldably support the deck 16 in position above the frame 12 for resilient movement toward the frame to accommodate bedding loads. The pattern and number of springs 14 may vary depending upon the size of the springs, number of cross rails, and other manufacturing and support characteristic considerations for the deck 16. One preferred pattern of spring placement is illustrated schematically in FIG. 2.

As best appears in FIGS. 1, 3, 4 and 6, each spring 14 comprises an intermediate upright yieldable portion 44 formed integrally at its upper end with a horizontal upper attaching platform 46 and formed integrally at its lower end to a horizontal lower mounting portion 48.

The upper attaching platform 46, which serves as a generally horizontal support platform for the wire deck 16, consists of an intermediate straight wire section 50, a pair of upper transverse torsion bars 52 which are disposed on opposite sides of section 50 in a spaced relation with the section 50 and in positions generally parallel to each other and to the straight section 50, and crosswise sections 54 which integrally connect the torsion bars 52 to opposite ends of the intermediate section 50.

The lower mounting portion 48 comprises a pair of substantially horizontally disposed mounting feet 56 having lower transverse torsion bars 58 located between the mounting feet 56 and the intermediate upright yieldable portion 44. Springs 14 are mounted to the cross rails and end rails 20 of the frame 12 by staples 60 over the lower torsion bars 58.

Figure 3:
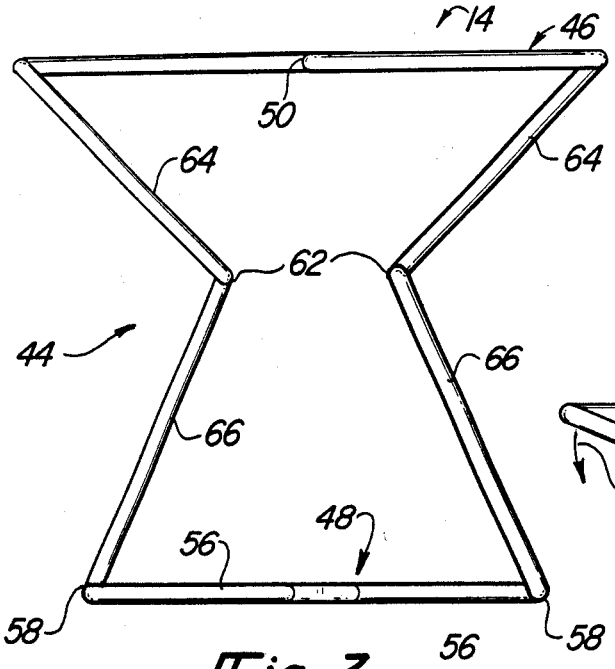
FIG. 3 is an isolated elevational view of one of the intermediate support springs of this invention in an unloaded position.

The intermediate yieldable portion 44 comprises a pair of vertically collapsible column sections to support the upper attaching platform 46 resiliently on the lower mounting portion 48. The column sections each include a middle transverse torsion bar 62 spaced vertically and horizontally inward from the upper torsion bar 52 in the upper attaching platform 46 and lower torsion bar 58 in the lower mounting portions 48. An upper connecting bar 64 connects one end of the middle transverse torsion bar 62 to one end of the upper transverse torsion bar 52 in the upper attaching platform 46. A lower connecting bar 66 connects the opposite end of middle torsion bar 62 with one end of the lower transverse torsion bar 58 in the lower mounting portion 48. As shown in FIG. 3 the torsion bars are located such that the upper connecting bars 64 diverge in an upward direction and the lower connecting bars 66 diverge in a downward direction.

Each upper transverse torsion bar 52 is arranged in a side-by-side relation with a straight wire 28 under an intersection 38 of the wires in the deck 16 as shown in FIG. 1. The side-by-side transverse torsion bars 52 and wires 28 are then secured together by wrap around clips 42 on either side of the intersection 38. This clamps wire 28, cross wire spring 30 and spring 14 together.

The portions of the wires 28 that are clipped to the springs 14 may be provided with a coating of a yieldable plastic material prior to the application of the clips 42, as disclosed in U.S. Pat. No. 4,186,223, also assigned to the assignee of this application. The plastic coating may be a vinyl coating, a polyurethane coating or of some other soft plastic coating that facilitates the application of the clips 42 to the springs 14 and the straight wires 28 of wire deck 16.

Alternatively, the upper transverse torsion bars 52 of the springs 14 can be provided with the coating or the entire deck 16 can be coated. Preferably, at least the areas of the deck 16 which engage the springs 14 are coated. This not only facilitates the application of the clips 42 but also eliminates any unwanted noise caused by relative movement of the deck 16 and the springs 14 which may occur when the assembly 10 is loaded and unloaded.

When a downward load is applied to the box spring assembly 10, the springs 14 and the cross wire springs 30 will yield in a vertical direction to accommodate the bedding loads and provide the occupant of a mattress supported on the deck 16 with the desired feel that is associated with comfort. The springs 14 will only permit a limited vertical deflection.

Figure 5:
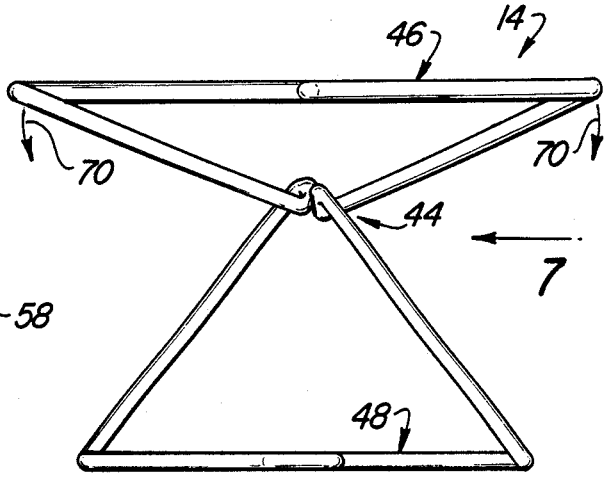
FIG. 5 is an elevation view of the intermediate support spring of this invention in a loaded position showing engagement of the torsion bars of the column sections to limit deflection of the spring.
Figure 4:
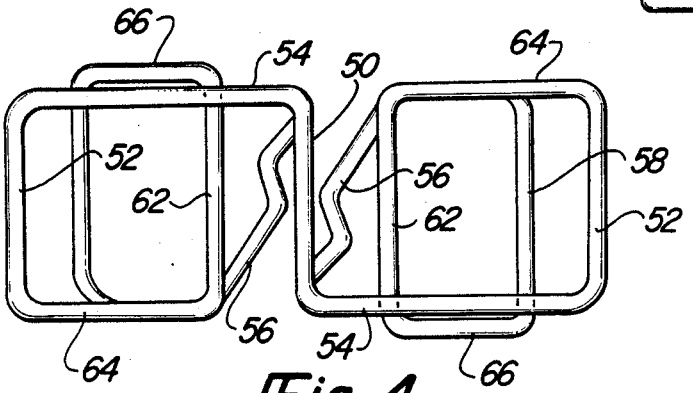
FIG. 4 is a plan view of the support spring of FIG. 3.

During deflection, the middle transverse torsion bars 62 of the column sections twist, rotating vertically, and move inwardly until the middle torsion bars 62 engage one another as shown in FIG. 5. This engagement limits the vertical deflection of the horizontal platform 46 to a fully deflected position in which the platform 46 is spaced a predetermined distance above the engaged torsion bars 62.

In the fully deflected position, lower connecting bars 66, as viewed from the side in FIG. 5, form a generally fixed triangular support which also limits further vertical deflection of the spring. The engaged torsion bars 62 form a fulcrum about which the platform 46 may pivot in the direction shown by arrows 70. This allows portions of the wire deck 16 to deviate from a generally horizontal plane to conform to applied bedding loads thereby increasing the comfort provided by the box spring assembly.

Figure 7:
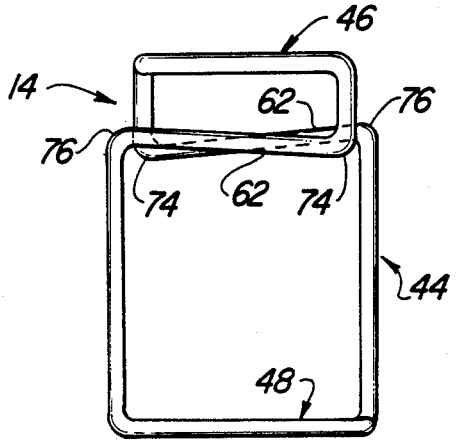
FIG. 7 is an end view of the loaded spring shown in FIG. 5 taken in the direction of the arrow 7.
Figure 6:
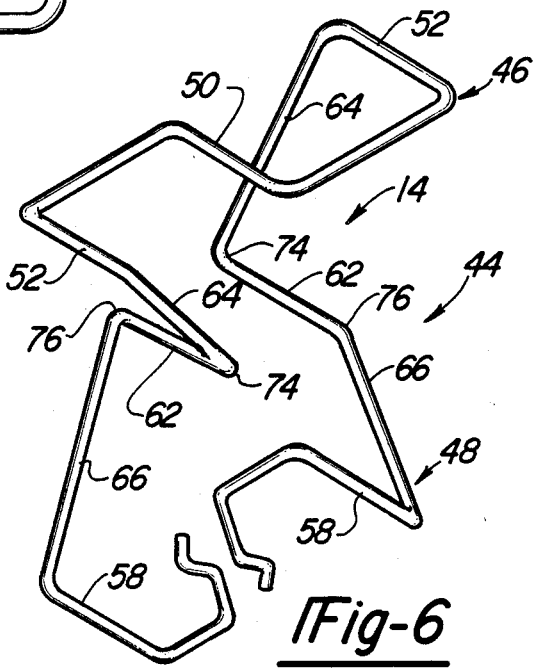
FIG. 6 is a perspective view of the intermediate support spring of this invention shown in FIG. 3.

Middle torsion bars 62 twist and rotate in a generally vertical plane as they move toward each other during deflection of springs 14. Ends 74 of torsion bars 62, shown in the perspective view of the spring 14 in FIG. 6, tend to rotate downward relative to ends 76 of torsion bars 62 which tend to rotate upward. When the bars 62 engage thus limiting any further deflection of the spring 14, the bars 62 are no longer parallel to one another. Bars 62 engage in a cross bucking pattern as shown in FIG. 7. FIG. 7 is a side view as viewed in the direction of arrow 7 of FIG. 6. This cross bucking engagement pattern assures that bars 62 will firmly engage one another to limit the spring deflection.

The spring disclosed in U.S. Pat. No. 4,559,654 also is of a limited deflection design. However, this design differs significantly from Applicant's invention. The deflection of the platform in U.S. Pat. No. 4,559,654 is limited by the cross bars of the platform itself contacting the torsion bars of the intermediate column section.

The spring 14 in Applicant's invention limits deflection by the engagement of the middle torsion bars 62 while the platform 46 is spaced above the middle torsion bars 62. This reduces the angular rotation and twist in the middle torsion bars 62 to less than the twist experienced by the corresponding bars of the spring shown in U.S. Pat. No. 4,559,654. Accordingly, the torsional stresses produced in Applicant's springs are less for springs of the same width.

With a reduced peak stress in spring 14, it is more difficult to stress the springs 14 during use of the assembly 10 to the point where they take a "set", thus providing the assembly 10 with a longer service life and allowing smaller diameter spring wire to be used to achieve a comparable service life. Smaller diameter spring wire is more ecomonical to produce thus reducing the overall cost of the assembly.

It is to be understood that the present invention is not limited to the exact construction or method illustrated and described above, but that various changes and modifications may be made without departing from the spirit and scope of the invention as defined in the following claims.

What is claimed is:

1. A spring for supporting a wire mattress support deck on a frame of a bedding unit;

said spring being formed of a single spring wire member which has a lower portion connectible to the said frame, an upper portion connectible to said wire deck and an intermediate portion connecting said lower portion to said upper portion, said intermediate portion being comprised of a pair of vertically collapsible column sections to support said upper portion resiliently on said lower portion;

said upper portion comprising a generally horizontal platform member having upper transverse torsion bars at its ends;

said lower portion comprising a pair of substantially horizontally disposed mounting feet having lower transverse torsion bars located at the ends of said lower portion;

said column sections each including a middle transverse torsion bar spaced both vertically and horizontally from said upper and lower torsion bars in said upper and lower portions, and connecting bars extending from opposite ends of each of said column section middle torsion bars and being formed integral with said transverse torsion bars in said upper and lower portions;

said middle torsion bars in said column sections being substantially horizontally aligned and spaced apart in the unloaded position of said spring and being movable toward each other in response to vertically collapsible movement of said column sections; and said column section middle torsion bars being movable into an engaged position during collapse of said column sections so as to thereby limit deflection of said platform toward said lower portion to a position in which said platform is spaced a predetermined distance above said engaged middle torsion bars.

2. The spring of claim 1 wherein said column section torsion bars engage one another in a cross buck manner.

3. The spring of claim 1 wherein said horizontal platform member includes a transverse straight wire section spaced between and parallel to said upper transverse torsion bars of said horizontal platform member.

4. A limited deflection spring comprising a wire body having an upright yieldable portion, a generally horizontal attaching platform at the upper end of said upright portion and a pair of mounting feet at the lower end of said upright portion, said attaching platform being substantially horizontal and including a pair of upper transverse torsion bars at its ends, said upright yieldable portion comprising a pair of upright collapsible column sections extending downwardly from said upper torsion bars, each of said collapsible sections including a middle transverse torsion bar spaced below and horizontally inwardly from said upper torsion bars in said attaching platform, a first connecting bar section extending upwardly from one end of each of said middle transverse torsion bars and being inclined outwardly toward and connected to one of said upper torsion bars in said attaching portion, a second connecting bar section extending downwardly and outwardly from the other end of each of said middle transverse torsion bars and connected to a torsion bar in each of said mounting feet; and said middle torsion bars being horizontally spaced apart in the unloaded position of said spring and being movable toward each other in response to collapse of said yieldable portion to engaged cross bucking positions in which the engagement of said middle torsion bars limits further deflection of the spring and further collapse of said yieldable portion to a position in which said platform is spaced vertically above said engaged middle torsion bars which form a fulcrum for said platform enabling rocking movement of said platform as a unit relative to said fulcrum, said engaged torsion bars cooperating with said downwardly extending connecting bars to form a generally triangular support section for said platform.

5. The spring of claim 4 wherein said attaching platform includes a transverse straight wire section spaced between and parallel to said transverse torsion bars of said attaching platform.

6. A bedding unit such as a box spring,comprising:

a frame;

a wire mattress support deck spaced above said frame; and a plurality of limited deflection springs resiliently supporting said deck from said frame, each of said springs having a wire body including an upright yieldable portion, a generally horizontal attaching platform at the upper end of said upright portion and a pair of mounting feet at the lower end of said upright portion, said attaching platform being substantially horizontal and including a pair of upper transverse torsion bars at its ends, said upright yieldable portion comprising a pair of upright collapsible column sections extending downwardly from said upper torsion bars, each of said collapsible sections including a middle transverse torsion bar spaced below and horizontally inward from said upper torsion bars in said attaching platform, a first connecting bar section extending upwardly from one end of said middle transverse torsion bar and being inclined outwardly toward and connected to said upper torsion bar in said attaching portion, a second connecting bar section extending downwardly and outwardly from the other end of said middle transverse torsion bar and connected to a torsion bar in one of said mounting feet, said middle torsion bars being horizontally spaced apart in the unloaded position of said spring and being movable toward each other in response to collapse of said upright yieldable portion to engaged cross bucking positions in which the engagement of said middle torsion bars limits further deflection of the spring and further collapse of said column sections to a position in which said platform is spaced above said engaged torsion bars, said engaged torsion bars forming a fulcrum for said platform enabling a rocking movement of said platform relative to said fulcrum, said engaged torsion bars cooperating with said downwardly extending connecting bars to form a generally triangular support section for said platform.

* * * * *